US007060915B2

(12) United States Patent
Bricaud et al.

(10) Patent No.: US 7,060,915 B2
(45) Date of Patent: Jun. 13, 2006

(54) MULTIPLE SWITCHING DEVICE

(75) Inventors: Hervé Guy Bricaud, Dole (FR); Yves Pizard, Dole (FR); David Wicker Thomas, Loveland, CO (US); James Howard Coughenour, Fort Collins, CO (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 11/065,500

(22) Filed: Feb. 24, 2005

(65) Prior Publication Data

US 2005/0205393 A1 Sep. 22, 2005

Related U.S. Application Data

(63) Continuation-in-part of application No. PCT/IB03/03416, filed on Aug. 21, 2003.

(30) Foreign Application Priority Data

Aug. 28, 2002 (FR) ..... 02 10699

(51) Int. Cl.
*H01H 13/70* (2006.01)
*H01H 25/00* (2006.01)

(52) U.S. Cl. ..... 200/5 R; 200/5 R; 200/5 A; 200/6 R; 200/6 A; 200/1 R

(58) Field of Classification Search ..... 200/329, 200/16 R, 16 C, 238, 406, 5 A, 5 R, 6 A, 200/6 R See application file for complete search history.

(56) References Cited

U.S. PATENT DOCUMENTS

| | | | | |
|---|---|---|---|---|
| 5,186,555 | A | 2/1993 | Chiba | |
| 6,479,776 | B1 * | 11/2002 | Nakase et al. | 200/559 |
| 6,635,832 | B1 * | 10/2003 | Oster et al. | 200/6 A |
| 6,906,269 | B1 * | 6/2005 | Nishimura et al. | 200/4 |
| 6,963,039 | B1 * | 11/2005 | Weng et al. | 200/302.1 |

FOREIGN PATENT DOCUMENTS

| | | |
|---|---|---|
| EP | 1 202 311 A2 | 5/2002 |
| JP | 2001135196 | 5/2001 |
| JP | 2002190235 | 7/2002 |
| WO | WO 2004/021381 A2 | 3/2004 |

* cited by examiner

*Primary Examiner*—Elvin Enad
*Assistant Examiner*—Lheiren Mae A. Anglo
(74) *Attorney, Agent, or Firm*—Peter Van Winkle

(57) ABSTRACT

A miniature switching device has an operating member (14) with an upstanding button (26) that can be rapidly slid in any one of four horizontal directions to close any one of four switches in a casing (12). A sheet metal conducting member (28) has a flat base portion (60) that lies in the casing under said operating member, and has four upstanding plates (62) that extend from bends (63) at the periphery of the base portion. Each plate has an upper end (81) that lies against a side of the operating member so horizontal movement of the operating member tilts a plate about a corresponding bend. Each plate has a finger (83) that extends largely horizontally from the plate and that engages a corresponding contact (56) on a bottom wall of the casing.

6 Claims, 7 Drawing Sheets

MULTIPLE SWITCHING DEVICE

CROSS-REFERENCE

This is a continuation-in-part of PCT application PCT/IB2003/003416 filed 21 Aug. 2003, which claimed priority from French application 02 10699 filed 28 Aug. 2002.

BACKGROUND OF THE INVENTION

Portable telephones and electronic organizers are now equipped with navigation devices which allow a pointer to be moved on the screen in one or other of two directions in order to select a function, as well as to validate the function selected when the pointer is in the desired position.

In order to move in two perpendicular directions and to validate, for example, by depressing a validation button, it is known to use an operating member which is articulated about two axes perpendicular to each other. The operating member can further be depressed in a direction perpendicular to the two articulation axes for validation. These arrangements are referred to as "joy-sticks" or dome-type navigators. Five contacts are associated with the operating member. Four are arranged at each side of the articulation axes of the operating member so that one is depressed when the operating member tilts about an axis.

A final contact is arranged in the central portion, under the operating member, in order to be depressed when the operating member is pressed.

In order to ensure that the operating member returns towards the rest position thereof, it is urged by resilient biasing means.

Portable electronic devices are used increasingly often for games and it is advantageous for selection using the switching device to be able to be carried out in a very rapid manner.

Although operating members articulated about two perpendicular axes are easy to use, it has been found that the operation speed thereof is limited owing to the required movement of the finger of the operator.

The object of the invention is to provide a multiple switching device which is very quick to operate.

SUMMARY OF THE INVENTION

The invention relates to a multiple switching device of the above-mentioned type, characterized in that the operating member can be rapidly slid, usually horizontally, relative to the casing in order to switch each of the contacts.

The present invention relates to a multiple switching device of the type comprising:

a casing;

at least two contacts which are each formed by a conductive stud carried by the casing and an associated movable conductive finger, the movable conductive finger being movable relative to the associated stud between a position in contact with the stud, which defines a closed state of the contact, and apposition remote from the stud, which defines an open state of the contact;

an operating member for controlling the movable fingers, which operating member can be moved relative to the casing from a rest position, in which each contact is in a first state out of the open and closed states, into at least two separate selection positions by movement in separate senses, in each of which a contact is in a second state; and resilient means for biasing the operating member towards the rest position thereof.

According to particular embodiments, the multiple switching device comprises one or more of the following features:

the movable conductive fingers are articulated relative to the body;

the movable conductive fingers extend into the space defined by the continuation of the operating member in the sliding direction thereof associated with the two contacts;

the movable conductive fingers are integral in the same common conductive member;

the resilient biasing means comprise at least two resiliently deformable plates which are integral with the common conductive member, the plates being pressed against the operating member in the rest position thereof;

the resilient plates form a cradle for receiving the operating member;

each movable conductive finger is carried by a resilient plate;

it comprises at least four contacts and the operating member can be moved in translation relative to the casing in two senses, in at least two overriding selection directions, the movement of the operating member in one sense in a direction from the rest position into a selection position bringing about the change in state of a contact;

it comprises four resilient plates which are associated in pairs, the resilient plates of a matching pair having edges for guiding the operating member which extend parallel with an overriding selection direction and which co-operate with lateral faces of the operating member in order to guide it in the overriding selection direction;

the casing comprises stops which prevent the simultaneous movement of the operating member in two overriding selection directions;

the operating member can be moved in translation relative to the casing in a direction perpendicular to the two overriding selection directions from the rest position thereof into a selection position, and it comprises a contact which is formed by a conductive stud carried by the casing and an associated movable conductive element, the movable conductive element being movable relative to the associated stud between a position in contact with the stud, which defines a closed state of the contact, and a position remote from the stud, which defines an open state of the contact, and it comprises additional resilient means for biasing the operating member towards the rest position thereof;

the movable conductive element comprises a conductive dome which is resiliently deformable under the action of the operating member, which dome is supported on the casing, and forms the additional resilient means for biasing the operating member towards the rest position thereof;

the movable conductive element is integral with the movable conductive fingers in the common conductive member;

the casing is generally generated by revolution and comprises bayonet connection profiles which are adapted to cooperate with complementary profiles of a supporting base plate;

the bayonet connection profiles comprise tabs which protrude radially relative to the casing which is generally generated by revolution; and the operating member comprises a control portion which protrudes through an opening provided in an upper surface of the casing and the operating member can be moved slidingly parallel with the upper surface of the casing in order to switch the contacts.

The invention will be better understood from a reading of the description below which is given purely by way of example with reference to the drawings, in which:

DESCRIPTION OF THE PREFERRED EMBODIMENT

Figure 1:
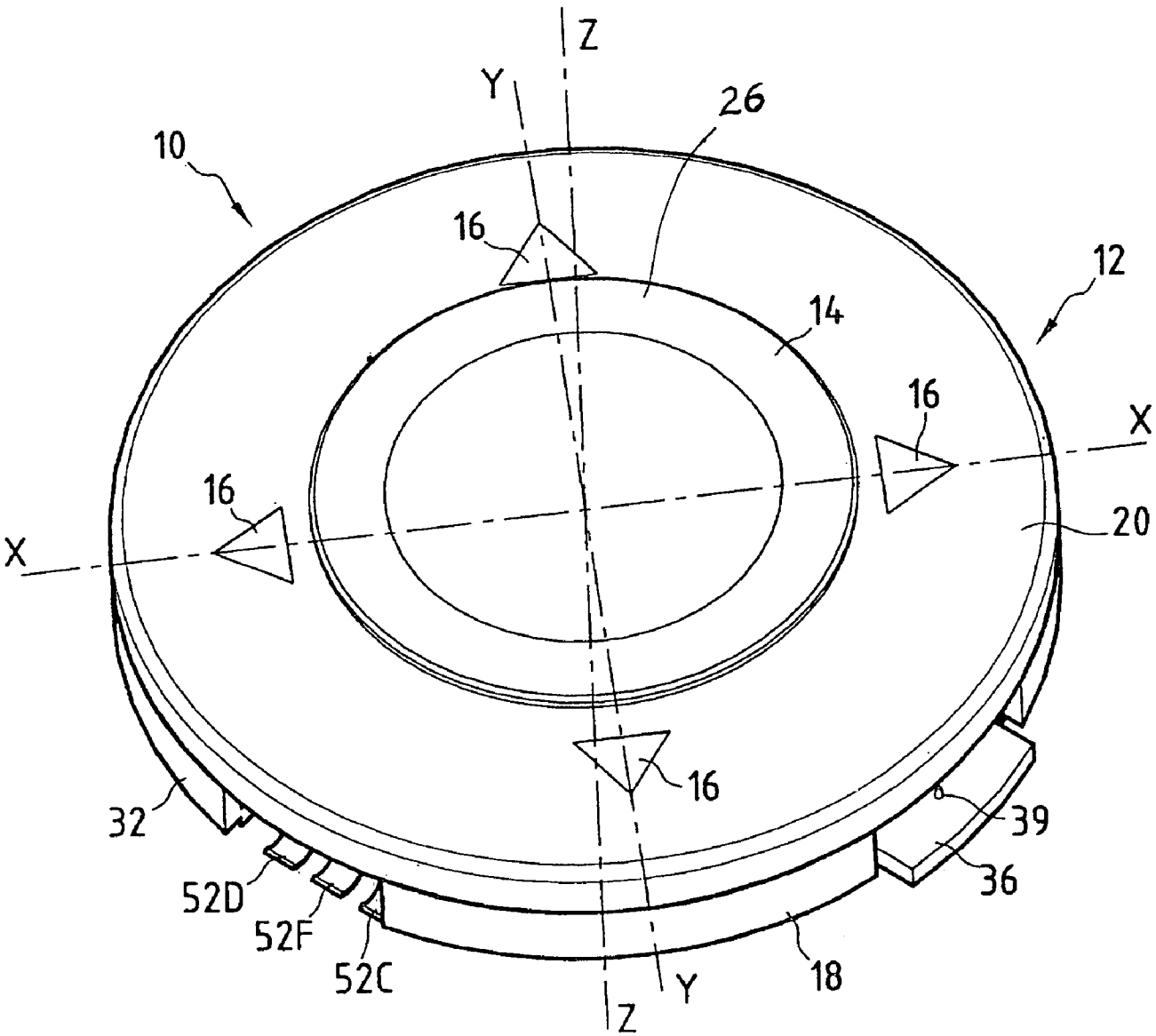
FIG. 1 is an exterior isometric view of the multiple switching device according to the invention.

The switching device 10 which is illustrated in the Figures and which is visible in the exterior view of FIG. 1 is intended to be used in a portable electronic apparatus and in particular a mobile telephone or a personal organizer. The switching device is generally in the form of a disc having a diameter of approximately 20 mm (0.79 inch) and a total height of 3.25 mm (0.13 inch).

The switching device comprises a casing 12 containing five contacts and an operating member 14 which can be moved relative to the casing 12 in order to bring about a change in state of at least one contact. These changes in state are produced for four contacts by horizontal sliding movements of the operating member 14 in horizontal directions X-X and Y-Y, as illustrated by arrows 16. A fifth contact connection is made by depressing the member 14 into the casing 12 in vertical direction Z-Z which is perpendicular to the two horizontal selection directions X-X and Y-Y.

Figure 2:
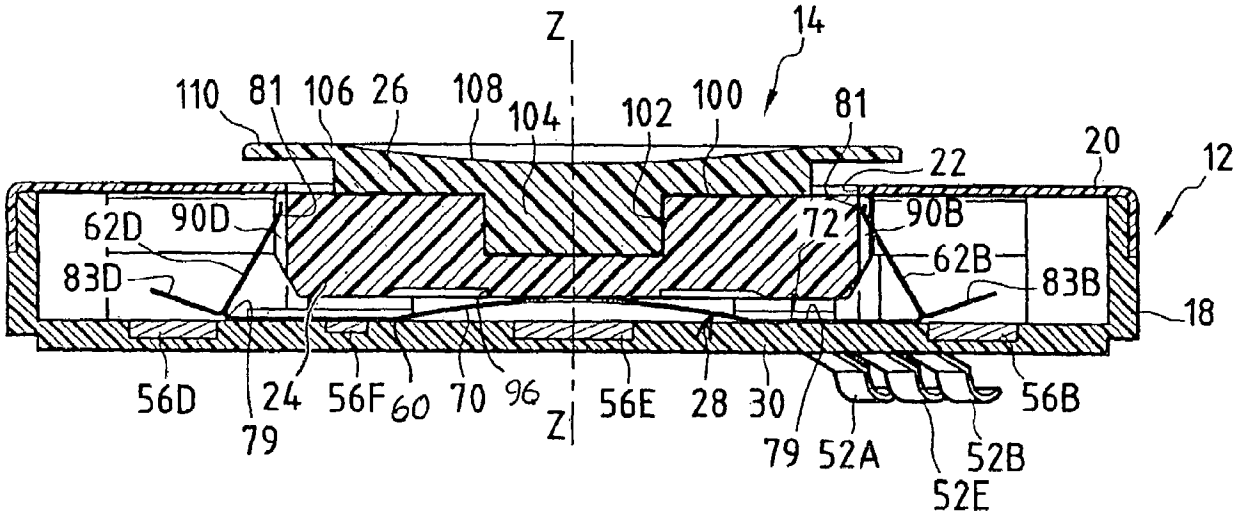
FIG. 2 is a cross-section of the device of FIG. 1 at rest.

As illustrated in FIG. 2, the casing 12 comprises a base unit 18 in the general form of a bowl. This base unit is closed by a cover 20. The cover has, in its central portion, an opening 22 for receiving the operating member 14. The cover 20 is held on the base unit 18 by being tightly fitted which is optionally complemented by crimping (not shown) of the cover to the base unit. The operating member 14 comprises a body 24 which is received inside the casing 12, and a button 26 which protrudes out of the casing through the opening 22. The button can be moved to operate any of a plurality of switches.

The casing 12 encloses a one-piece sheet metal conductive member 28 which is common to the various contacts. The member 28 has parts that are deformable by the operating member 14 to cause the selective making of electrical connections for all five contacts.

Figure 3:
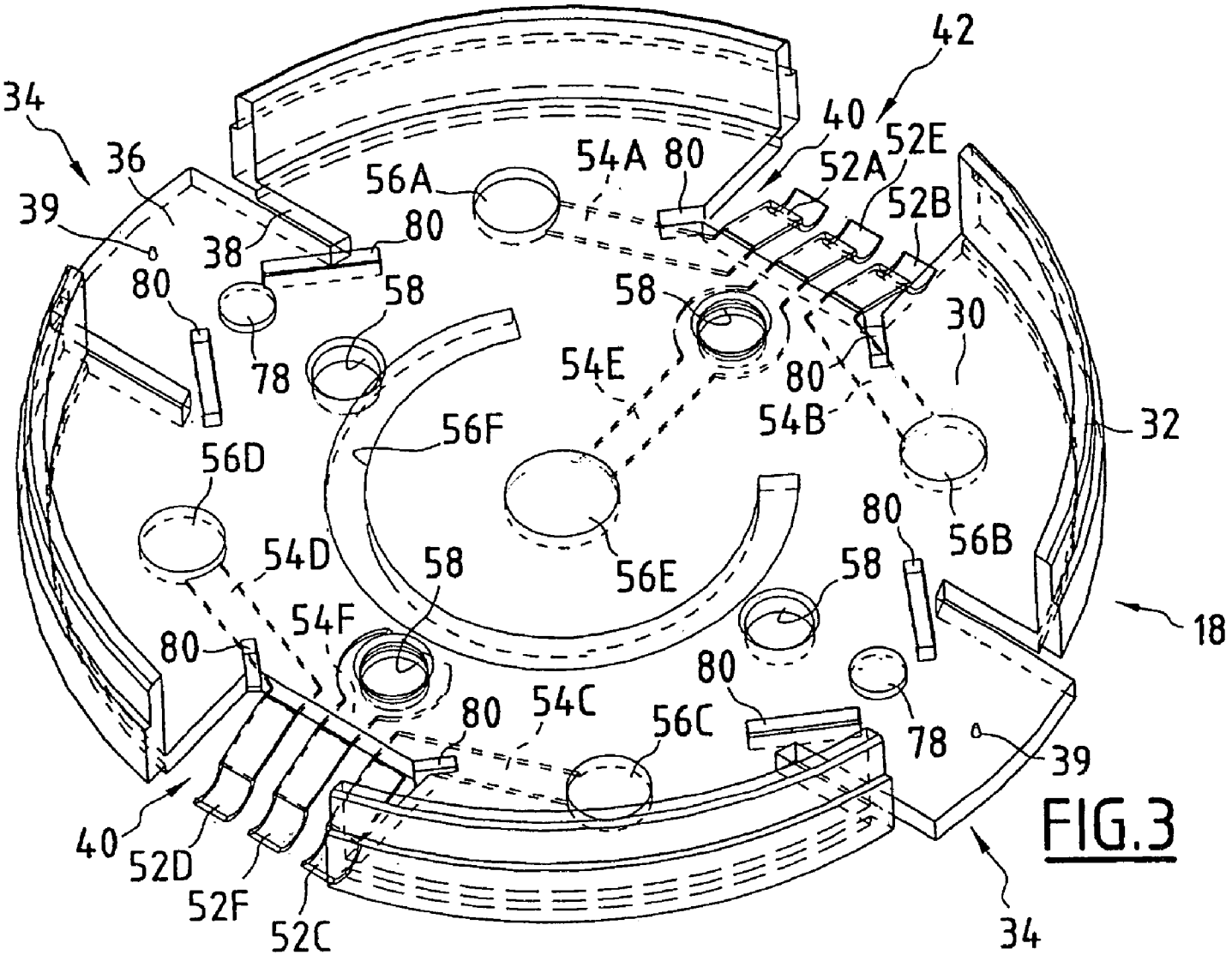
FIG. 3 is an isometric view showing the hidden edges of the base unit of the device.

The base unit 18, illustrated alone in FIG. 3, is produced from an insulating material, such as a plastic material. It has a generally annular bottom 30 which is provided at the edge with a cylindrical upstanding wall 32. The wall 32 has four openings 34 distributed around the periphery of the base unit.

Fixing tabs 36 which are integral with the bottom 30 and which protrude radially beyond the upstanding wall 32 and lie in the plane of the bottom 30 are provided at two openings 34. The tabs have slots 38 that provide resilience of the tabs. The tabs are suitable for fitting the base unit to a receiving base plate by bayonet connection, the protruding ends of the tabs 36 being received in corresponding grooves of the base plate.

In order to ensure retention by resilient engagement of the device on the base plate, each tab 36 comprises a projection 39 on the internal face thereof which is adapted for being received in a complementary recess provided in the base plate. The bottom 30 has cut-outs 40 which are provided in the region of the other two openings, indicated at 42, of the upstanding wall 32.

Resilient connections lugs 52A, 52B, 52C, 52D, 52E, 52F extend at right angles from the cut-outs 40 and protrude beyond the external face of the bottom 30. The conductive lugs provide an electrical connection by simple pressure without soldering of the switching device to printed circuit tracks, against which the base unit 18 is held. At the free end thereof, the resilient lugs have a dishing which allows electrical connection by simple contact against corresponding studs of a printed circuit.

The conductive lugs are aligned in groups of three in the cut-outs 40 along chords of the cylindrical bottom 30. Each of the resilient outer lugs 52A, 52B, 52C, 52D is connected by a conductive track 54A, 54B, 54C, 54D to a contact stud 56A, 56B, 56C, 56D. The contact studs are provided on the internal (upper) face of the bottom 30 and are arranged at the four corners of a square.

In addition, the central lug 52E is connected by a conductive track 54E to a central contact stud 56E (also, FIG. 2) which is arranged at the intersection of the diagonals of the square which are defined by the studs 56A, 56B, 56C, 56D.

Finally, the central lug 52F is connected by a conductive track 54F to a conductive portion 56F (also, FIG. 2) which is provided on the bottom 30. This conductive region is in the form of a circular arc which extends through substantially 270° and which is centered about the central stud 56E in order to ensure electrical contact with the common conductive member 28 (FIG. 2), irrespective of the movement direction of the operating member. The tracks 54A, 54B, 54C, 54D, 54E and 54F (FIG. 3) are formed by conductive strips which are partially embedded by over-molding in the material which forms the bottom 30.

The assembly of the conductive lugs, conductive tracks, contact studs and the conductive region is initially formed in a conductive metal plate, such as of stainless steel. This plate is stamped and swaged in order to obtain the desired forms by cutting. After the over-molding operation, the exposed portions of the conductive lugs, conductive tracks, contact studs and the conductive region are coated or silvered.

Four through-holes 58 (FIG. 3) are provided for guiding the operating member 14 (FIG. 2) when it is moved along axis Z-Z. The holes lie in the bottom 30 (FIG. 3) at the four corners of a square which is centered about the central stud 56E. These holes are tapered to form a centering profile. Two holes 58 extend through the tracks 54E and 54F, which have portions which extend around the holes.

Figure 4:
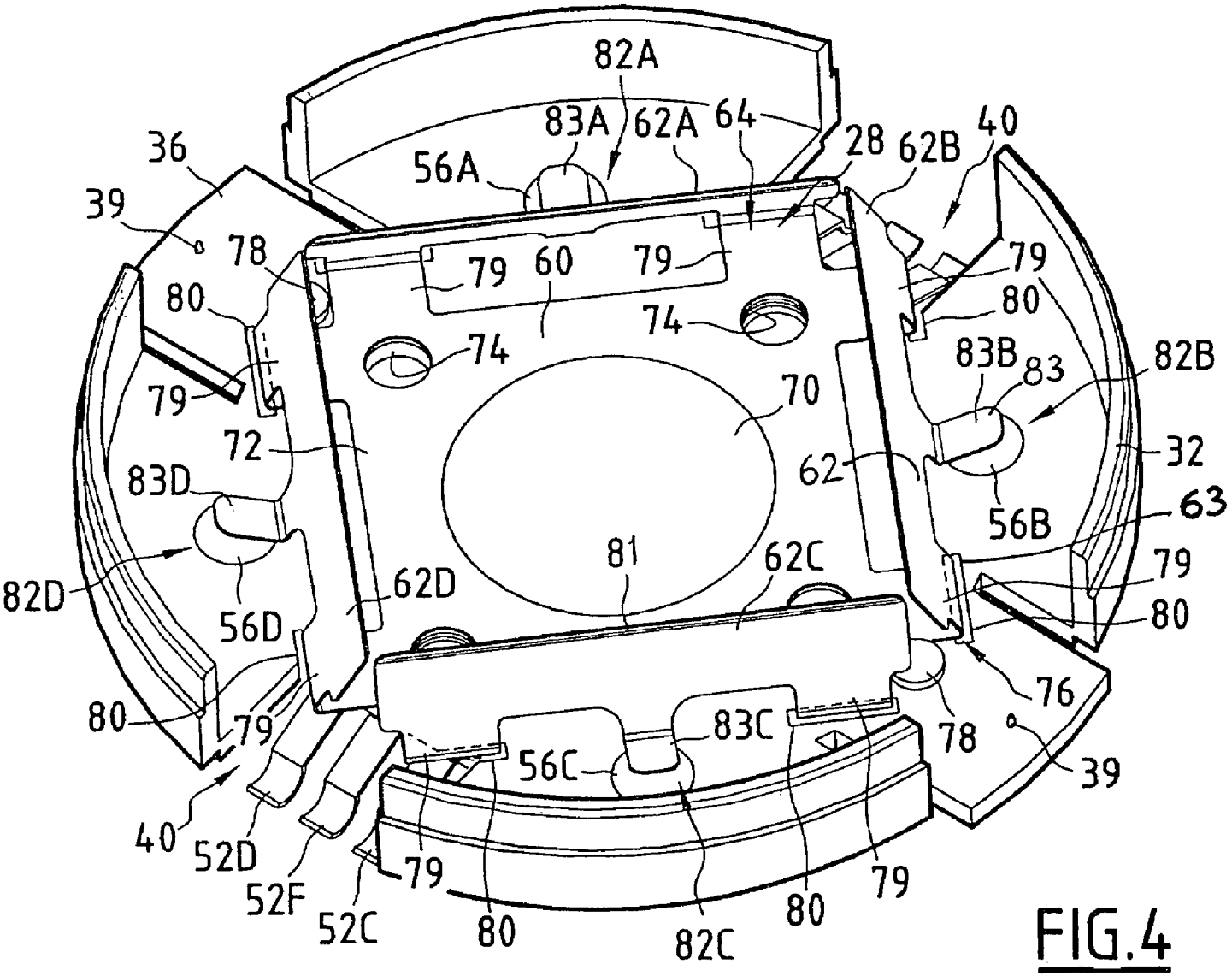
FIG. 4 is an isometric view of the base unit and the common conductive member of the device.

As illustrated in FIG. 4, the common sheet metal conductive member 28 has a generally flat base 60 that rests on the bottom 30 of the base unit. The base 60 has a square external shape and is provided at its edge with four resilient plates 62A, 62B, 62C, 62D (FIG. 4). The plates 62 are connected by bends 63 to the base. The base 60 and plates 62 together form a cradle 64 (FIG. 4) for receiving the body 24 of the operating member. The plates 62 are integral with the base 60 and are generally resiliently articulated partially to the sides of the square base.

In greater detail, the base 60 is generally flat and the conductive member has a dome 70 at a central portion of the base. The dome protrudes into the cradle 64, that is away from the bottom 30 of the base unit. The dome 70 lies above the central contact stud 56E (FIG. 2) and is adapted to be resiliently deformed until it comes into contact with the stud 56E, thereby creating an electrical connection.

The dome 70 at rest has a height on the order of 0.35 mm with a diameter which is approximately from 10 to 20 times greater and, in this case, which is 6 mm.

The dome 70 (FIG. 4) is surrounded by an annular flat region 72 of the base 60. The flat region 72 is supported on the arc-shaped conductive region 56F (FIG. 3).

The base 60 has, in its flat region 72 (FIG. 4), four holes 74 which are aligned with the holes 58 in the base unit.

The four corners of the base 60 are each provided with a V-shaped notch 76 with two of them receiving fixing studs 78 which protrude above the bottom 30 in the region of the tabs 36. The studs 78 are integral with the bottom and rest against the two edges which define the notch 76, thereby ensuring positioning and fixing of the resilient member 28 in the plane of the bottom of the base unit.

Figure 5:
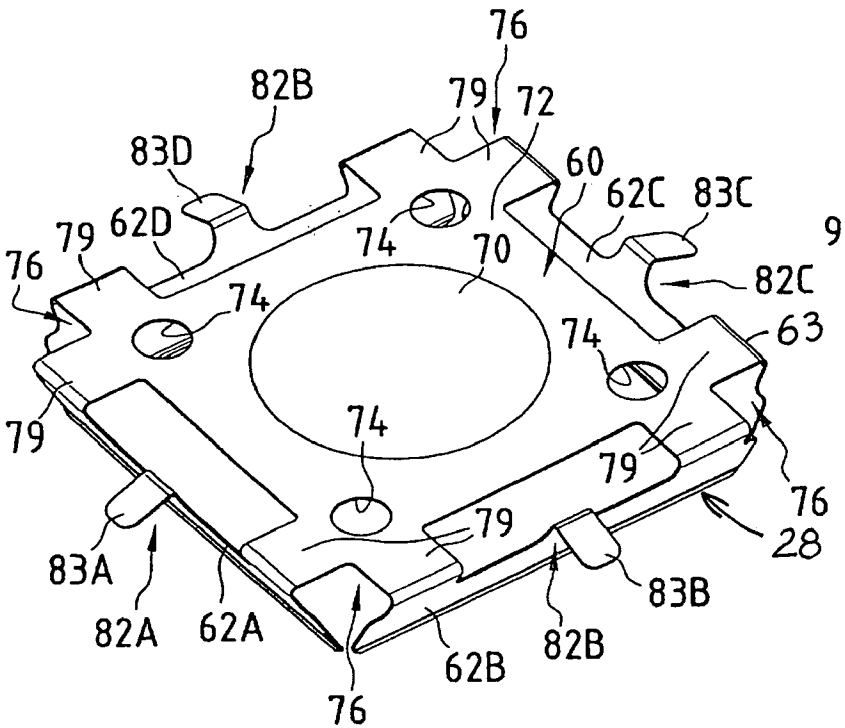
FIG. 5 is an isometric view of the common conductive member which is illustrated upside-down.

The resilient plates 62A, 62B, 62C, 62D (FIG. 5) are connected to the base 60 by arms 79. Ends of the arms form hinges at bends 63. The radius of curvature of each bead is on the order of 0.1 mm. The bends 63 lie on slots 80 (FIG. 4) of the base unit.

The slots 80 are generally of rectangular form, the length thereof being greater than the width of the corresponding arm 79. The slots receive the bends, or hinges of the arm during the resilient deformation of the associated plate.

The opposing resilient plates 62A, 62B, 62C, 62D converge relative to each other towards the free end thereof.

Each plate 62A to 62D extends above the base 60 and forms an angle on the order of 55° from the horizontal base 60. The upper free edge or end 81 (FIG. 4) of each plate is slightly curved outward in order to form an edge for engaging the body 24 (FIG. 2) of the operating member.

The middle of each plate 62 (FIG. 4) has a conductive tab 82A, 82B, 82C, 82D which is integral with the associated plate and resiliently deformable. Each tab 82A–82D is bent to project outwardly. The bent end of each tab forms a contact finger 83A, 83B, 83C, 83D. Each finger 83 extends at an angle of approximately 100° with the rest of the plate. The tabs are bent about axes that are parallel to the axes of bending of the top edges of the plates 62A, 62B, 62C, 62D. The common conductive member 28 is formed from the same stainless spring steel plate which is approximately 50 μm thick and which has been cut and shaped, then coated or silvered.

As illustrated in the figures, each contact finger 83 generally extends at an angle to an associated contact stud such as 56A. At rest and as illustrated in FIGS. 2 and 4, the contact fingers of tabs such as 83B and 83D are remote from the associated conductive studs such as 56D and 56B, respectively, and define an angle of approximately 25° therewith.

Figure 6:
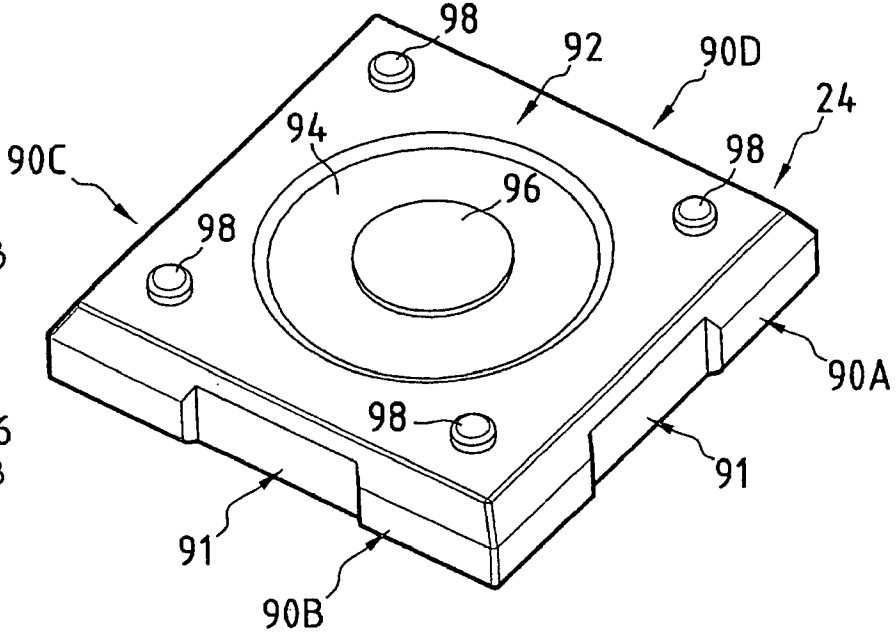
FIG. 6 is an isometric view of the body of the operating member, which is illustrated upside-down.

The body 24 (FIG. 2) of the operating member is illustrated alone in an upside-down orientation in FIG. 6. It is generally in the form of a parallelepipedal. Its outside dimensions are slightly greater than those of the cradle 64 (FIG. 4) which includes the plates 62A, 62B, 62C, 62D so that the body is held and positioned without play between the plates 62A, 62B, 62C, 62D in a central rest position (e.g. at 62B, 62D in FIG. 2). The body 24 is received in the cradle formed by member 28 between the resilient plates. The plate upper ends lie against faces 90A, 90B, 90C, 90D of the body. These body faces each have a central cut-out 91 (FIG. 6) which limit turning of the plates 62A, 62B, 62C, 62D in the body.

At the lower face of the body designated 92, the body 24 has a central portion with an annular bowl 94 which forms a central stud 96 or projection which presses on the top of the resilient dome 70. The body 24 is kept in contact against the cover 20 (FIG. 2) at another face. The diameter of the projection 96 is approximately half of the diameter of the dome, which is approximately 3 mm, in order to ensure permanent contact of the top of the dome 70 against the projection 96 and thus to hold the body 24 against the cover 20, irrespective of the selection position or rest position of the operating member.

Four pins 98 (FIG. 6) protrude from the lower face 92 of the body 24. They have a peripheral centering chamfer at the top thereof. The pins are adapted for being received in holes 58 (FIG. 3) of the base unit 18 when the operating member is depressed.

At the upper face of the body 24 as illustrated in FIG. 2, the body has a space 102, in which a protruding portion 104 of the button 26 is force-fitted. The protruding portion 104 is provided with an annular retention portion. The button is round and has a receiving indentation 108 for a finger for operating the device. This indentation is provided with an anti-slip surface, such as a spiral groove, and can be provided with a coating of a polymer, such as polyurethane.

The indentation 108 leads to a collar 110 which increases laterally the surface of the button beyond the periphery of the opening 22. The outside diameter of the button is 11 mm (0.4 inch) to be pressed by a person's finger.

The button 26 protrudes above the casing 12 by a height which is far less than its diameter. This height is on the order of 1 mm, allowing vertical travel of approximately 0.35 mm when the button is depressed.

It will be appreciated that the body 24 is movable in horizontal sliding translation in all directions perpendicular to axis Z-Z whilst being held in contact with the cover 20 by the resilient action of the dome 70.

The form of the four flat resilient plates (e.g. 62B, 62D in FIG. 2), combined with the flat lateral surfaces (at 91, FIG. 6) on the body 24 reduces the possibility of rotation of the operating member 14 about the vertical axis Z-Z. In the rest state this arrangement brings the body 24 and the button 26 back into the starting position.

According to a first embodiment, the opening 22 (FIG. 2) in the cover 20 is circular, and is large enough to allow movement of the same magnitude of the operating member 14 in all directions perpendicular to axis Z-Z.

Figure 7:
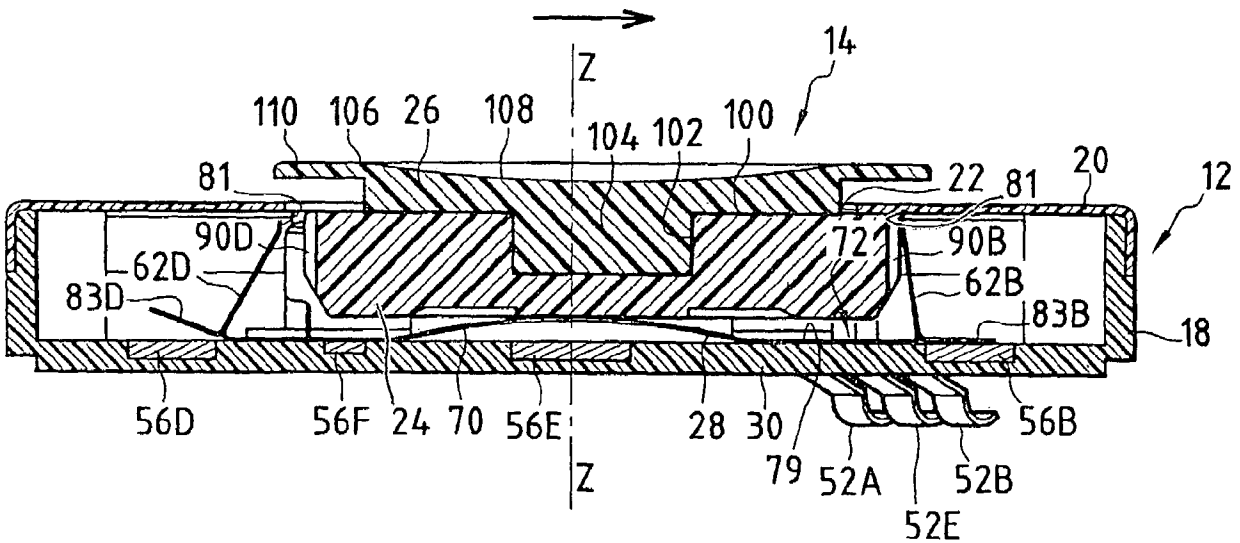
FIG. 7 is a view similar to that in FIG. 2 of the device in a switching position.

When the operating member is moved laterally in horizontal direction X-X, as illustrated in FIG. 7, one or two resilient plates, such as plate 62B, is tilted toward the vertical. This tilts the contact finger 83B of the plate into contact with the stud 56B underneath, thereby establishing an electrical connection between the corresponding stud 56B and the common conductive member 28 which includes the plates such as 62B and the dome 70.

The conductive stud 56B is connected to a lug 52B, as shown in FIG. 3. The base of the conductive member is supported on the annular conductive surface 56F (FIG. 3) which is connected to the lug 52F. As a result, an electrical connection is brought about between the lugs 52B and 52F when the operating member 14 is moved to the position of FIG. 7.

When the operating member 14 is released, it is urged back by the deformed resilient plate(s) and is brought back towards its rest position illustrated in FIG. 2. In this position, no electrical connection is produced, the contact fingers all being moved away from the associated studs.

The action of the four resilient plates on the lateral flat surfaces of the body 24 of the operating member allows the operating member to be slid back to its starting position without pivoting about axis Z-Z.

Sliding movement of the operating member 14 in one of the two main horizontal directions X-X, Y-Y (FIG. 1) perpendicular to axis Z-Z allows the lug 52F (FIG. 3) to be connected through conductive member 28 to at least one of the studs 56A, 56B, 56C, 56D. As a result the lug 52F is placed in communication with one of the terminals 52A, 52B, 52C, 52D via the conductive member 28.

During sliding movement in a horizontal main direction X-X or Y-Y, the body 24 (FIG. 2) of the operating member is guided laterally at both sides by the free top edges 81 of the resilient plates which generally extend parallel to the sliding movement direction. The travel of the operating member in a horizontal main direction in order to bring about switching is approximately 0.8 mm.

The operating member 14 can move along a diagonal of the square defined by the resilient plates 62A, 62B, 62C, 62D (FIG. 4), that is, in a direction extending 45° to the main directions X-X and Y-Y. During such movement two adjacent resilient plates are resiliently deformed and urged outwards, leading to contact fingers and associated conductive studs being simultaneously placed in contact. This ensures that the lug 52F is placed in communication with the two lugs which correspond to the studs, against which the contact fingers are pressed. In this manner, the selection device forms a selector having eight selection paths and one validation path.

Finally, when the operating member 14 is in its rest position, as illustrated in FIG. 2, the pins 98 (FIG. 6) at the bottom of the body 24 are arranged facing holes 58 (FIG. 3). This allows movement of the operating member 14 along the vertical axis Z-Z by the operating member 14 being depressed inside the casing 12. The chamfers provided at the periphery of the pins 98 facilitate the engagement and centering of the pins inside the holes 58. The holes are themselves flared at the end thereof that open at the internal face of the bottom 30.

When the operating member 14 (FIG. 2) is depressed, the dome 70 is resiliently deformed and the central portion thereof is pressed against the central stud 56E by the stud 96, thereby ensuring that the lugs 52F and 52E are placed in communication via the conductive member 28.

The shape of the dome, which is known, is adapted so that the force necessary for deformation is non-linear. In particular, the development of this force has a local minimum which is perceptible to the user which ensures a tactile effect informing the user of the correct depression of the operating member and the electrical switching. The change in state of the electrical contact is carried out simultaneously with the variation in depression force producing the tactile effect, as is known.

The presence of the pins 98 and complementary holes 58 ensures that the depression of the operating member, and therefore the placing of the central stud 56E in communication with the conductive member 28, is possible only when the operating member is in the rest position thereof, as illustrated in FIG. 2. It should be noted that, in this position, guiding in translation along axis Z-Z of the operating member is also ensured by the resilient plates 62A, 62B, 62C, 62D which apply a centering action to the operating member.

As a variant, the pins 98 are dispensed with in order to permit depression of the operating member, and therefore validation, irrespective of the position of the operating member.

According to another embodiment, the switching device is adapted to allow the terminal 52F (FIG. 3) to be placed in communication only with a single stud 56A, 56B, 56C, 56D at a time so that the device forms a selector having four selection paths and one validation path.

Figure 8:
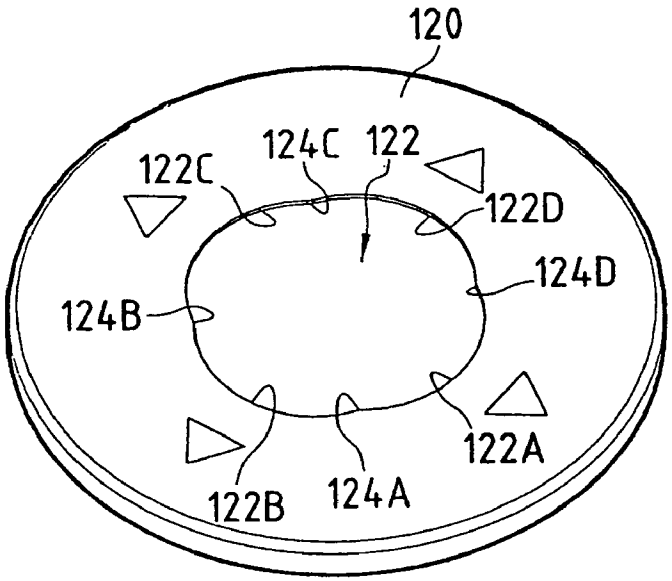
FIG. 8 is an isometric view of a specific embodiment of a cover of the casing of the device according to the invention.

To this end, and as illustrated in FIG. 8, the casing cover indicated 120 has an opening 122 which is shaped so be to limit the movement of the operating member in some directions. In particular, the opening 122 is generally in the form of a trefoil which has four recesses 122A, 122B, 122C, 122D which are arranged in the overriding movement directions X-X and Y-Y. Bulging portions 124A, 124B, 124C, 124D form stops and are arranged between the recesses in order to essentially prevent the movement of the operating member 14 in directions which extend at 45° relative to the overriding directions X-X and Y-Y.

When such a switching device is used, the movement in translation of the operating member in parallel with the bottom of the casing allows an extremely rapid connection of the contact fingers 83A, 83B, 83C, 83D (FIG. 4) to the corresponding studs as well as a very rapid disengagement of the fingers from the associated studs. In this manner, the switching device can be used to carry out very rapid control of a portable electronic device, in particular in the games sector. Such a device is particularly advantageous for arcade games.

In order to move the switching device successively and rapidly towards a selection position, it is possible to brush the upper surface of the button with an alternating movement of a person's finger. The person's finger draws the button in one direction and allows the button to move automatically back towards the rest position thereof when the finger is slightly disengaged from the button.

This alternating brushing movement by the finger of the user is very readily carried out so that a plurality of successive selections can be carried out very rapidly owing to the sliding of the operating member.

The use of a single member which simultaneously ensures the resilient biasing of the operating member 14 towards the rest position in translation and angular position thereof and the guiding of this operating member, allows a switching device to be produced at a very low cost. Only one sheet metal piece is used to enable the closing of five switches, provide biasing against movement in five directions, and provide guiding of the operating member. Finally, translation movement of the operating member 14 with the articulated contact fingers 83A, 83B, 83C, 83D (FIG. 4) allows the casing to have a greatly reduced height.

In the device described here, the movement of the operating member 14 towards a selection position brings contacts into engagement. In a variant, the contacts are engaged when the operating member is at rest and the movement of this member towards a selection position brings engagement of the associated contacts.

Figure 9:
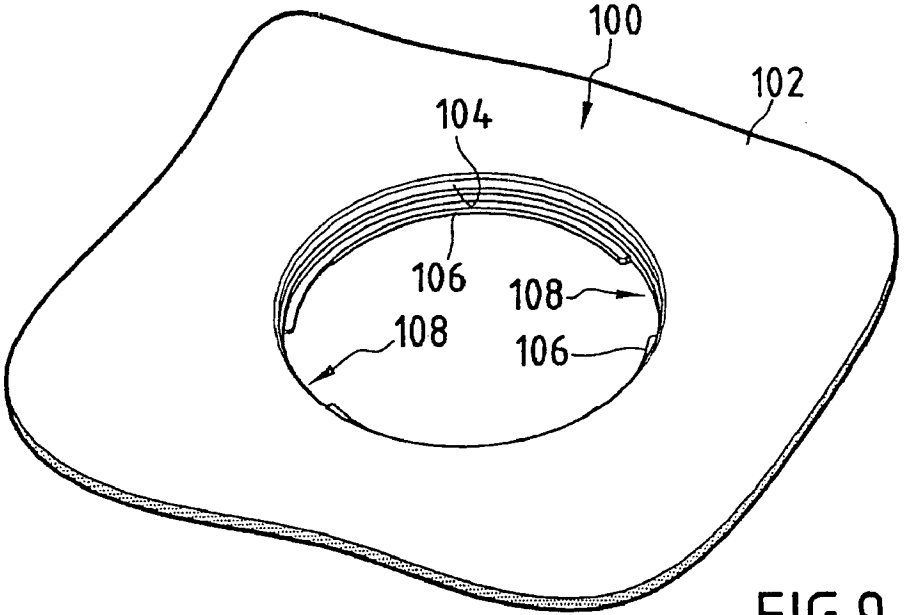
FIG. 9 is an isometric view of the base plate for receiving the switching device according to the invention.

FIG. 9 illustrates a base plate 100 for receiving a switching device according to the invention. The base plate is formed, for example, in the outer casing of a piece of portable electronic equipment, in which the switching device is integrated. This is, for example, the upper face of a mobile telephone. The base plate may be a wall 102 of plastic material. The base plate comprises a generally cylindrical hole 104 for receiving the body of the switching device. This hole is of reduced height substantially corresponding to the height of the casing 12. It has, at the lower end thereof, two helical ribs 106 which are symmetrical relative to the axis of the hole. The ribs extend substantially through 120° and together form two through-slots 108 for the ribs, or tabs 106 which protrude radially beyond the outer lateral surface of the casing.

The ribs 106 have an increasingly large thickness starting from the openings 108 towards the other end thereof in order to form a ramp for retaining the tabs 36 by a wedging effect. Stops 110 (FIG. 10) are further provided on the ribs 106 opposite the openings 108 in order to define the fixing position of the switching device. The ribs are further each provided with a recess which is adapted to receive the projection 39 (FIG. 4) in order to ensure resilient engagement of the tabs 36 in the base plate.

Figure 10:
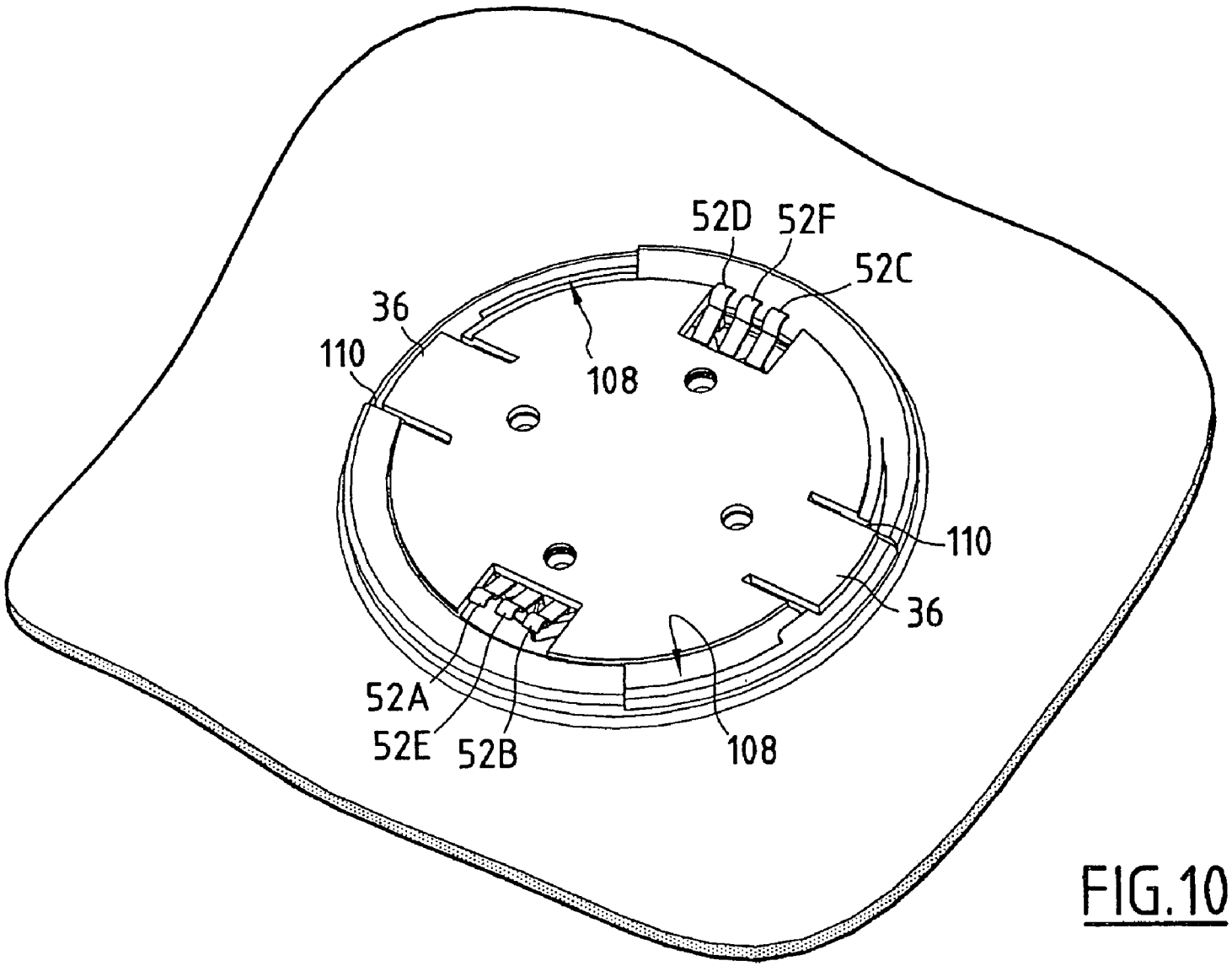
FIG. 10 is an isometric view of the switching device received in the base plate, viewed from the side of the base unit of the device.

As illustrated in FIG. 10, it will be appreciated that the switching device is engaged in the base plate 100 at the outer face of the electronic equipment. In particular, the tabs 36 are engaged in the openings 108.

The device is then rotated about itself through 40° so that the tabs 36 engage below the ribs 106 until the tabs abut the stops 110 and the projections 39 engage in the complementary recesses.

The device is then in the position in FIG. 10, where it is held by the bayonet arrangement and the resilient engagement of the complementary projections and recesses provided on the tabs and slots. The conductive lugs 52A, 52B, 52C, 52D, 52F then come into contact with the printed circuit of the electronic equipment when the wall 102 and the printed circuit are assembled.

It will be appreciated that the base plate having a cylindrical shaft which is associated with the generally cylindrical shape of the switching device and the arrangement of bayonet retention means allows centering of the switching de vice relative to the base plate. In particular, at the outer face of the electronic equipment, the switching device can be precisely flush, without any unattractive play between the switching device and the casing of the equipment in which it is integrated. The absence of play brings about sealing against dust between the outside and the inside of the electronic equipment as well as a "sealing" in respect of the illuminating light which can emanate from electro-luminescent diodes positioned on the printed circuit near the switching device.

Although terms such as "horizontal" and "vertical" have been used to help describe the illustrated switching device, it should be noted that the device can be used in any orientation.

What is claimed is:

1. A multiple switching device, comprising:

an insulative support;

a plurality of contacts mounted on said support;

a sheet metal conducting member having a base portion lying in a horizontal plane and a plurality of plates each connected by a bend to extend out of said horizontal plane and each plate having a finger, said conductive member being moveable along a first horizontal direction to move a first finger against and away from engagement with a first of said contacts and along a second horizontal direction to move a second finger against and away from a second contact;

an operating member coupled to said conductive member base portion and being slideable horizontally on said support with said conductive member base portion, said operating member having a button part that is moveable by a person's finger;

said operating member has a largely horizontal lower operating member surface and has largely vertical peripheral locations;

said base portion of said conductive member lies under said operating member lower surface and extends in a horizontal plane;

said plates each projects primarily upward from one of said bends to lie beside one of said peripheral locations of said operating member, so when the operating member slides horizontally it pushes horizontally against at least one of said plates to pivot the finger of the plate about a corresponding one of said bends.

2. A multiple switching device, comprising:

an insulative support;

a plurality of contacts mounted on said support;

a sheet metal conducting member having a base portion lying in a horizontal plane and including four plates each connected by a bend to said base portion, said base portion and said plates forming a cradle, each bend lying on a different one of the four sides of an imaginary parallelogram, and each plate extending from one of said bends and out of said horizontal plane and each plate having a finger, said conductive member being moveable along a first horizontal direction to move a first finger against and away from engagement with a first of said contacts and along a second horizontal direction to move a second finger against and away from a second contact;

an operating member coupled to said conductive member base portion and being slideable horizontally on said support with said conductive member base portion, said operating member having a button part that is moveable by a person's finger;

said operating member is slideable on said support along each of said directions;

said operating member is nested in said cradle, with horizontal movement of said operating member towards any of said four sides of the parallelogram causing pivoting of at least one of said plates to press the corresponding finger against the corresponding contact.

3. A multiple switching device comprising:

a casing forming a cavity with a primarily flat horizontal bottom wall;

a plurality of contacts each mounted in said casing on said bottom wall;

a sheet metal conductive member lying in said cavity, said conductive member having a largely flat base portion lying over said flat bottom wall, said base portion having a periphery and said conductive member having a plurality of plates each connected by a bend about a primarily horizontal axis to the periphery of said base portion so each plate has a part that extends largely vertically upward from the base portion periphery;

an operating member that lies over said base portion and inside said plates, said operating member being slideable horizontally to bend said plates against corresponding one of said contacts;

each of said plates having an upper end that lies against a side of said operating member, and each plate having a finger that is connected by a bend to the corresponding plate, the finger extending primarily horizontally from said bend.

4. A multiple switching device comprising:

a casing forming a cavity with a primarily flat horizontal bottom wall;

a plurality of contacts each mounted in said casing on said bottom wall and having an upwardly facing surface;

a sheet metal conductive member lying in said cavity, said conductive member having a largely flat base portion lying over said flat bottom wall, said base portion having a periphery and said conductive member having a plurality of plates each connected by a plate bend about a primarily horizontal axis to the periphery of said base portion so each plate extends largely vertically upward from the base portion periphery;

an operational member that is slideable horizontally with respect to said base portion to abut a corresponding part of at least one of said plates at a time to pivot the plate and thereby pivot a second part of the plate from a position above a corresponding one of said contacts and largely downward to a position against the upwardly facing surface of the corresponding contact surface.

5. The device described in claim 4 wherein:

said base portion lies on said casing bottom wall and said conductive member forms a dome within said base portion that has a convex dome upper surface and a concave dome lower surface, one of said contacts lying under said dome and said operating member being depressable to deflect said dome lower surface against said one of said contacts.

6. The device described in claim 4 wherein:

each of said plates has a finger that is connected by a finger bend to the corresponding plate, the finger extending primarily horizontally from the finger bend and the finger pivoting down to engage one of said contacts when the first part of the plate is abutted by said operating member to pivot the plate.

* * * * *